US012710182B2

(12) United States Patent
Kim et al.

(10) Patent No.: US 12,710,182 B2
(45) Date of Patent: Aug. 18, 2026

(54) CEILING-TYPE AIR CONDITIONER

(71) Applicant: Samsung Electronics Co., Ltd., Suwon-si (KR)

(72) Inventors: Jungwon Kim, Suwon-si (KR); Byungghun Kim, Suwon-si (KR); Hyunggeun Park, Suwon-si (KR); Moonsun Shin, Suwon-si (KR); Wonhee Lee, Suwon-si (KR); Jangjung Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 27 days.

(21) Appl. No.: 18/653,755

(22) Filed: May 2, 2024

(65) Prior Publication Data

US 2024/0280273 A1 Aug. 22, 2024

Related U.S. Application Data

(63) Continuation of application No. PCT/KR2022/017988, filed on Nov. 15, 2022.

(30) Foreign Application Priority Data

Jan. 10, 2022 (KR) ..... 10-2022-0003520

(51) Int. Cl.
*F24F 1/0063* (2019.01)
*F24F 1/0022* (2019.01)
(Continued)

(52) U.S. Cl.
CPC ..... *F24F 1/0063* (2019.02); *F24F 1/0022* (2013.01); *F24F 13/081* (2013.01); *F24F 13/20* (2013.01); *F24F 2221/14* (2013.01)

(58) Field of Classification Search
CPC ..... F24F 1/0063; F24F 1/0022; F24F 13/081; F24F 13/20; F24F 2221/14; F24F 1/00;
(Continued)

(56) References Cited

U.S. PATENT DOCUMENTS 10,302,314 B2 * 5/2019 Lee et al. ..... F24F 1/0014
2008/0035317 A1 * 2/2008 Choi et al. ..... F24F 1/0063 165/122

FOREIGN PATENT DOCUMENTS

CN 1309272 8/2001
CN 113357808 A * 9/2021 ..... F24F 1/0047
(Continued)

OTHER PUBLICATIONS

CN 113357808 A Translation (Year: 2021).*
(Continued)

*Primary Examiner* — Jerry-Daryl Fletcher
*Assistant Examiner* — Dario Antonio DeLeon
(74) *Attorney, Agent, or Firm* — Nixon & Vanderhye P.C.

(57) ABSTRACT

Disclosed herein is a ceiling-type air conditioner including: a cabinet mountable on a ceiling, a centrifugal fan disposed within the cabinet, a heat exchanger disposed on a radially outer side of the centrifugal fan and configured to exchange heat with air discharged from the centrifugal fan, and a holder adjacent to the heat exchanger and disposed between the heat exchanger and the centrifugal fan and configured to support the heat exchanger, wherein the holder includes a body extending vertically along an inside of the heat exchanger, an air guide protruding from the body toward the centrifugal fan side and configured to guide airflow discharged from the centrifugal fan, and a cover protruding from the body toward the heat exchanger configured to cover between the body and the heat exchanger.

14 Claims, 16 Drawing Sheets

(51) Int. Cl.
*F24F 13/08* (2006.01)
*F24F 13/20* (2006.01)

(58) Field of Classification Search
CPC ..... F24F 1/0047; F24F 1/0067; F24F 13/24; F24F 13/30; F24F 13/08
See application file for complete search history.

(56) References Cited

FOREIGN PATENT DOCUMENTS

| | | | | | |
|---|---|---|---|---|---|
| JP | 3066149 | B2 | | 7/2000 | |
| JP | 2000304347 | A | * | 11/2000 | ..... F24F 13/24 |
| JP | 2001-099436 | | | 4/2001 | |
| JP | 2001099436 | A | | 4/2001 | |
| JP | 2006-226595 | | | 8/2006 | |
| JP | 2006226595 | A | * | 8/2006 | ..... F24F 13/30 |
| JP | 2014109386 | A | | 6/2014 | |
| JP | 2017096587 | A | | 6/2017 | |
| KR | 20010060500 | A | | 7/2001 | |
| KR | 100344593 | B1 | | 7/2002 | |
| KR | 20020096319 | A | * | 12/2002 | ..... F24F 13/24 |
| KR | 100782195 | B1 | | 12/2007 | |
| KR | 20170020146 | A | | 2/2017 | |
| KR | 101902886 | B1 | | 10/2018 | |
| KR | 102058375 | B1 | | 12/2019 | |
| KR | 20200057365 | A | * | 5/2020 | ..... F24F 13/30 |
| KR | 102124387 | B1 | | 6/2020 | |
| KR | 102203437 | B1 | | 1/2021 | |
| KR | 20210089326 | A | | 7/2021 | |

OTHER PUBLICATIONS

KR 20200057365 A Translation (Year: 2020).*
JP 2006226595 A Translation (Year: 2006).*
KR 20020096319 A Translation (Year: 2002).*
JP 2000304347 A Translation (Year: 2000).*
Extended European Search Report dated Jan. 8, 2025 issued in European Patent Application No. 22919001.2.
European Intent to Grant issued Jun. 17, 2025 in corresponding European Patent Application No. 22 919 001.2.
International Search Report for PCT/KR2022/017988 mailed Mar. 6, 2023, 4 pages.
Written Opinion of the International Search Authority for PCT/KR2022/017988 mailed Mar. 6, 2023, 4 pages.
Korean Office Action dated Mar. 25, 2026 for KR Application No. 10-2022-0003520.

* cited by examiner

CEILING-TYPE AIR CONDITIONER

CROSS-REFERENCE TO RELATED APPLICATIONS

This application is a continuation of International Application No. PCT/KR2022/017988 designating the United States, filed on Nov. 15, 2022, in the Korean Intellectual Property Receiving Office and claiming priority to Korean Patent Application No. 10-2022-0003520, filed on Jan. 10, 2022, in the Korean Intellectual Property Office, the disclosures of each of which are incorporated by reference herein in their entireties.

BACKGROUND

Field

The disclosure relates to a ceiling-type air conditioner capable of being installed on an indoor ceiling.

Description of Related Art

In general, an air conditioner is a device that is equipped with a compressor, a condenser, an expansion valve, an evaporator, a blowing fan, and controls indoor temperature, humidity, airflow, and the like using a refrigeration cycle. An air conditioner may be classified into a separate type, which has an indoor unit placed indoors and an outdoor unit placed outdoors, and an integrated type, in which both the indoor unit and the outdoor unit are placed in one housing.

For a ceiling-type air conditioner, an indoor unit may be installed on an indoor ceiling. The indoor unit of the ceiling-type air conditioner may draw in indoor air, exchange heat with a heat exchanger, and then discharge the heat-exchanged air.

The ceiling-type air conditioner is also equipped with a heat exchanger that exchanges heat between refrigerant and air, a blowing fan that moves air, and a motor that drives the blowing fan to cool or heat an indoor room.

SUMMARY

Embodiments of the disclosure provide a ceiling-type air conditioner, which is an indoor unit mounted on the ceiling, including a structure that guides an airflow discharged from a centrifugal fan while supporting a heat exchanger.

Embodiments of the disclosure provide a ceiling-type air conditioner that may include a structure that guides an airflow discharged from a centrifugal fan to reduce noise that may occur in a heat exchanger.

According to an example embodiment of the disclosure, a ceiling-type air conditioner includes: a cabinet mountable on a ceiling, a centrifugal fan disposed within the cabinet, a heat exchanger disposed on a radially outer side of the centrifugal fan and configured to heat exchange with air discharged from the centrifugal fan, and a holder adjacent to the heat exchanger and disposed between the heat exchanger and the centrifugal fan and configured to support the heat exchanger, wherein the holder includes a body extending vertically along an inside of the heat exchanger, an air guide protruding from the body toward the centrifugal fan side and configured to guide airflow discharged from the centrifugal fan, and a cover protruding from the body toward the heat exchanger and configured to cover between the body and the heat exchanger.

The body may include a first side disposed on an upstream side of a direction of the airflow to be discharged from the centrifugal fan and a second side disposed on a downstream side of the direction of the airflow, and the cover protrudes from the first side of the body toward the inside of the heat exchanger and is configured to guide the airflow toward the air guide.

The holder may include a support extending from the body and configured to support a lower side of the heat exchanger, and an angle formed by the cover with an extending direction of the support may be in a range of 20 degrees to 75 degrees.

The cover may have a thickness in a range of ¼ times to ⅔ times the thickness of the body.

The heat exchanger may include a refrigerant pipe arranged to at least partially surround the centrifugal fan, and heat exchange fins arranged along the refrigerant pipe, the inside of the heat exchanger may be defined by the heat exchanger fins, and the cover may be arranged to contact the inside of the heat exchanger.

The holder may further include a support extending from the body and configured to support a lower side of the heat exchanger, and a cabinet coupling portion coupled to the cabinet on the opposite side of the support, and the cover may extend from the cabinet coupling portion toward the support.

A protruding length of the cover on a side adjacent to the cabinet coupling portion may be greater than a protruding length of the cover on a side adjacent to the support.

A distance between the support and an end of the cover adjacent to the support may be less than a distance between the support and an end of the air guide adjacent to the support.

The holder may further include a support extending from the body and configured to support a lower side of the heat exchanger, the heat exchanger may include a refrigerant pipe arranged to at least partially surround the centrifugal fan, and heat exchange fins arranged along the refrigerant pipe, wherein the support may include a support plate bent and extended from the body and configured to cover a portion of the lower side of the heat exchanger, a catch plate bent from the support plate in parallel with the body and configured to support the outside of the heat exchanger, and a fastening protrusion protruding from the support plate and the catch plate toward the heat exchanger and configured to be inserted between adjacent heat exchange fins of the heat exchange fins.

The catch plate may include an inclined surface inclined downwardly toward the body and the support plate configured to guide the heat exchanger toward the support plate.

The air guide may extend from the first side of the body along the direction of the airflow, and include guide grooves arranged in a vertical direction at a distal end protruding from the body and configured to allow air discharged from the centrifugal fan to pass therethrough.

The cabinet may include a guide protrusion protruding toward the holder and configured to be coupled to the holder, and the holder may further include a guide hole into which the guide protrusion is configured to be inserted, a fastening hole disposed adjacent to the guide hole configured to allow a fastener to be inserted, and a cabinet coupling portion bent from the body.

The holder may be provided in a plurality, the heat exchanger may include a first side and a second side adjacent to a piping portion, and a third side and a fourth side arranged in parallel with the first side and the second side, the holder may be installed on the third side and the fourth side, wherein the holder is disposed closer to a corner disposed on a downstream side of the direction of the airflow discharged from the centrifugal fan, of corners provided on both sides of each of the third side and the fourth side.

The cabinet may include a base and an outer wall extending downwardly from an outside of the base, and an outer protrusion protruding downwardly from the base and configured to secure the outside of the heat exchanger.

The holder may include a synthetic resin.

According to an example embodiment of the disclosure, a ceiling-type air conditioner includes: a cabinet mounted on a ceiling, a centrifugal fan disposed within the cabinet, a heat exchanger disposed on a radially outer side of the centrifugal fan and configured to heat exchange with air discharged from the centrifugal fan, a holder installed on an inner side of the heat exchanger, and the holder including a cabinet coupling portion configured to be coupled to the cabinet, a body extending from the cabinet coupling portion along the inner side of the heat exchanger, and a support extending from the body configured to support a lower side of the heat exchanger, and further includes an air guide protruding from the body toward the centrifugal fan configured to guide airflow discharged from the centrifugal fan, and a cover protruding from the body toward the inner side of the heat exchanger configured to cover between the heat exchanger and the body so as to guide the airflow discharged from the centrifugal fan to the air guide.

The body may include a first side disposed on an upstream side of a direction of the airflow discharged from the centrifugal fan and a second side disposed on a downstream side of the direction of the airflow, and the cover protrudes from the first side of the body toward the inside of the heat exchanger to guide the airflow toward the air guide.

The angle at which the cover may form with a lateral direction of the body is from 15 degrees to 70 degrees, and the cover may have a thickness of from ¼ to ⅔ times the thickness of the body.

The cover may extend from the cabinet coupling toward the support, and a protruding length of the cover on a side adjacent to the cabinet coupling portion may be greater than a protruding length of the cover on a side adjacent to the support.

According to an example embodiment of the disclosure, a ceiling-type air conditioner includes: a cabinet installable on a ceiling and including a base and an outer wall extending downwardly from an outside of the base, a centrifugal fan disposed in the cabinet configured to draw air in from a lower side and discharge the air toward the outer wall of the cabinet, a heat exchanger disposed between the outer wall of the cabinet and the centrifugal fan configured to exchange heat with the air discharged from the centrifugal fan and including a first side and a second side on which a piping portion is located and a third side and a fourth side facing the first side and the second side, respectively, a drain plate disposed on a lower side of the heat exchanger, and a holder secured to the base and supporting the heat exchanger, the holder including a cabinet coupling portion coupled to the base, a body extending from the cabinet coupling portion in a vertical direction of the heat exchanger, and a support extending from the body to a space between the heat exchanger and the drain plate configured to support the lower side of the heat exchanger, and further includes a first side disposed on an upstream side of a direction of airflow discharged from the centrifugal fan and a second side disposed on a downstream side of the direction of the airflow, the holder provided in a plurality, and each disposed on the third side and the fourth side and arranged adjacent to the downstream side of the direction of the airflow discharged from the centrifugal fan at each of the third side and the fourth side, and the holder includes an air guide protruding from the first side of the body toward the second side configured to guide the air discharged from the centrifugal fan, and a cover protruding from the body toward the heat exchanger configured to cover a space between the body and the heat exchanger.

According to various example embodiments of the present disclosure, the ceiling-type air conditioner may support the heat exchanger and simultaneously control the airflow discharged from the centrifugal fan.

According to various example embodiments of the present disclosure, the ceiling-type air conditioner may guide the air discharged from the centrifugal fan to reduce the noise of the airflow introduced into the heat exchanger fin.

According to various example embodiments of the present disclosure, the ceiling-type air conditioner may include a structure capable of covering the space between the heat exchanger and the holder.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Figure 1:
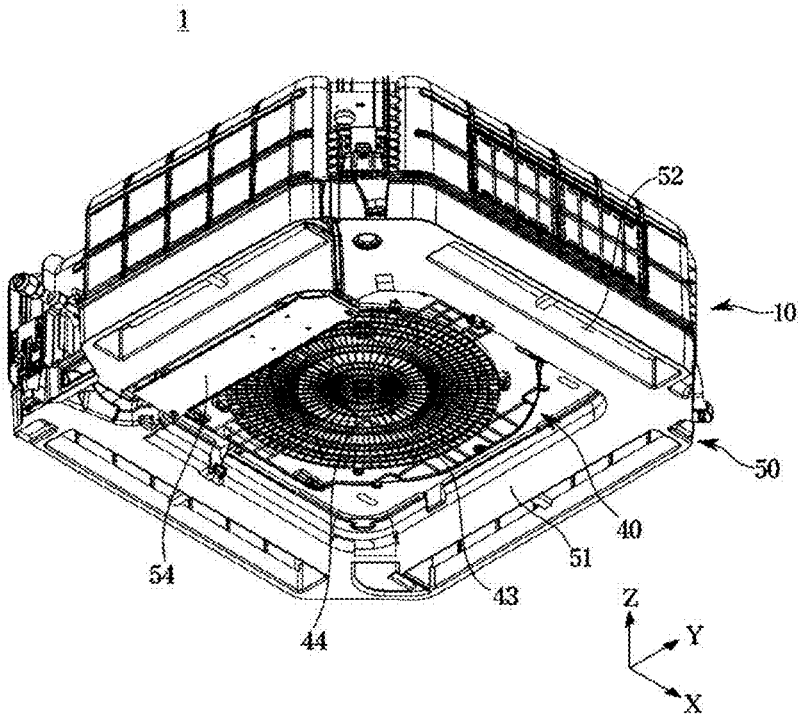
FIG. 1 is a perspective view of a ceiling-type air conditioner according to various embodiments.

Embodiments described in the disclosure and configurations shown in the drawings are merely examples of various example embodiments of the disclosure and may be used in various different ways.

In addition, the same reference numerals or signs shown in the drawings of the disclosure indicate elements or components performing substantially the same function.

The terms used herein are used to describe the various example embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, figures, steps, operations, elements, components, or combinations thereof, but do not preclude the presence or addition of one or more of the features, figures, steps, operations, elements, components, or combinations thereof.

It will be understood that, although the terms "first", "second", "primary", "secondary", etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

As used herein, the terms "front", "rear", "upper", "lower", "left", "right", and the like are defined with reference to the drawings and are not intended to limit the shape and location of each component.

Hereinafter, a ceiling-type air conditioner will be described in greater detail with reference to the accompanying drawings as an example, but is not limited to being mounted on the ceiling.

Referring to FIG. 1, a ceiling-type air conditioner 1 may be mounted on a ceiling of an indoor room. At least a portion of the ceiling-type air conditioner 1 may be embedded in the ceiling. The ceiling-type air conditioner 1 may be referred to as an indoor unit 1.

The ceiling-type air conditioner 1 may include a cabinet 10 having a substantially square shape. The cabinet 10 may be arranged to be embedded in the ceiling and open downwardly. A lower panel 50 may be disposed on a lower side (−Z direction) of the cabinet 10. The lower panel 50 may include a lower plate 51 forming an opening 52 arranged to discharge air from the inside of the cabinet 10 downwardly.

The openings 52 may be formed in four and arranged on sides facing each other, each extending in an X direction or a Y direction. The number of openings 52 may be four as shown in the drawings, but the openings 52 are not limited thereto. The indoor unit 1 may include a separate cover member (not shown) on the lower side (−Z direction). The cover member may have a square shape or a circular shape depending on the shape in which the cover member is installed on the ceiling.

A drain plate 40 may be provided between the lower panel 50 and the cabinet 10. A central portion of the drain plate 40 may be coupled with a grille 43 forming a hole 44 through which air flows into the inside of the cabinet 10. The grille 43 may include an approximately circular shape.

A controller 54 may be provided adjacent to the hole 44. The controller 54 may control signals to turn the indoor unit 1 on/off in response to an input from a user.

Figure 2:
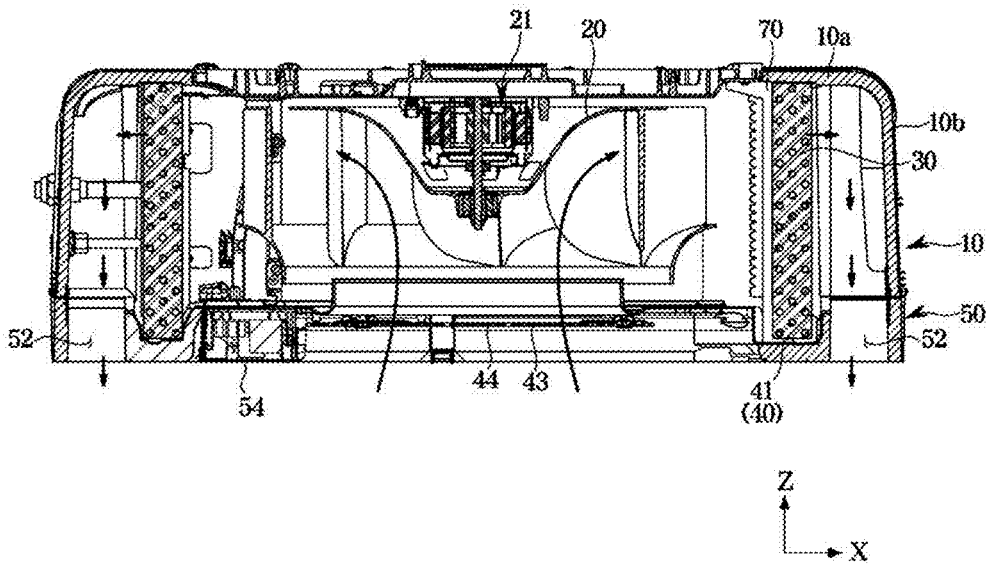
FIG. 2 is a cross-sectional view of the ceiling-type air conditioner according to various embodiments.

Referring to FIG. 2, the cabinet 10 may include a base 10*a* mounted horizontally on the ceiling, and an outer wall 10*b* extending downwardly (−Z direction) from the outside of the base 10*a*. A centrifugal fan 20 flowing air may be disposed on the inside of the cabinet 10. A drive motor 21 arranged to drive the centrifugal fan 20 may be disposed on an upper side (Z direction) of the centrifugal fan 20.

The circular grille 43 forming the hole 44 may be disposed on the lower side (−Z direction) of the centrifugal fan 20. The hole 44 may be disposed adjacent to a central axis of the centrifugal fan 20.

The indoor unit 1 of the ceiling-type air conditioner may include a heat exchanger 30 disposed on a radially outer side (X direction) of the centrifugal fan 20 to heat exchange the air discharged from the centrifugal fan 20. The heat exchanger 30 may be disposed on the upper side (Z direction) of a drain tray 41 to allow condensed water generated in the heat exchanger 30 to be collected in the drain tray 41. The heat exchanger 30 may have a substantially square shape and may be arranged to surround the centrifugal fan 20.

One side of the heat exchanger 30 facing the centrifugal fan 20 may be an inner side 30*a* of the heat exchanger 30, and the other side facing the outer wall 10*b* of the cabinet 10 may be an outer side 30*b*. In addition, a portion adjacent to the drain tray 41 of the heat exchanger 30 may be a lower side 30*c*.

The indoor unit 1 of the ceiling-type air conditioner may include a holder 70 arranged to support the inner side 30*a* of the heat exchanger 30. The holder 70 may be disposed between the heat exchanger 30 and the centrifugal fan 20 and may be coupled to the base 10*a* of the cabinet 10 to extend downward (−Z direction). The holder 70 may be disposed between the drain tray 41 and the heat exchanger 30.

In other words, air introduced through the hole 44 formed on the lower side (−Z direction) about the central axis of the centrifugal fan 20 may be discharged to the radially outer side (X direction) of the centrifugal fan 20. The air discharged from the centrifugal fan 20 may be heat exchanged by the heat exchanger 30. When the ceiling-type air conditioner 1 (see FIG. 1) is in a cooling mode, the temperature of the air discharged from the centrifugal fan 20 may be reduced by the heat exchanger 30. Similarly, when the indoor unit 1 of the ceiling-type air conditioner is in a heating mode, the temperature of the air discharged from the centrifugal fan 20 in the radially outer side (X direction) may be increased by heat exchange with the heat exchanger 30.

The air heat exchanged by the heat exchanger 30 may flow in a space between the heat exchanger 30 and the outer wall 10*b* of the cabinet 10 and be discharged to the lower side of the cabinet 10 through the openings 52 disposed on the lower side (−Z direction).

Furthermore, although not shown in the drawings, a panel including a separate inlet may be disposed on a lower side of the lower panel 50.

Figure 3:
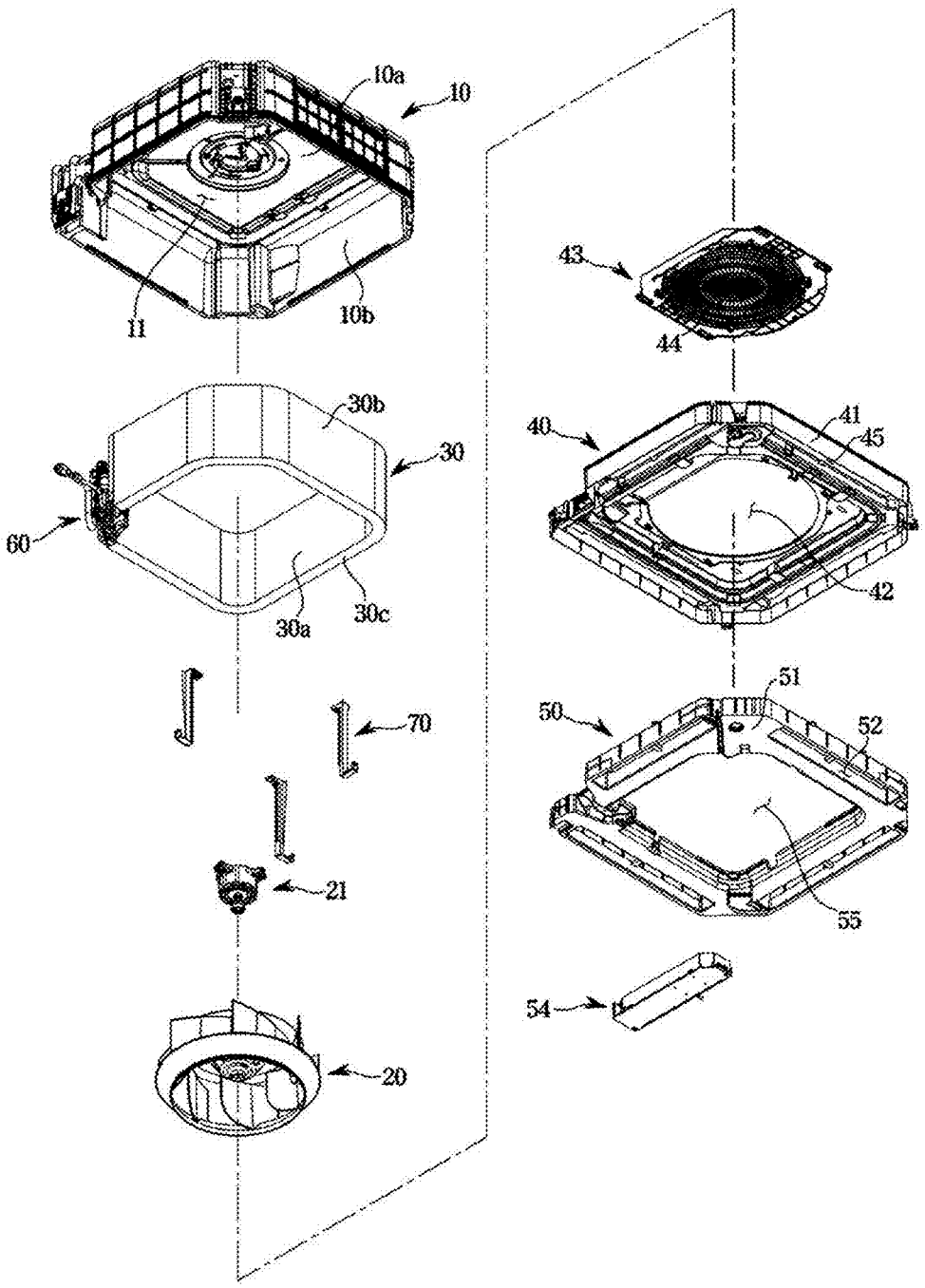
FIG. 3 is an exploded perspective view of the ceiling-type air conditioner according to various embodiments.

Referring to FIG. 3, the cabinet 10 may be formed to be open downward by having an opening 11 formed by the base 10*a* and the outer wall 10*b*. The heat exchanger 30, the centrifugal fan 20, the drive motor 21, and the holder 70 may be inserted into the cabinet 10 through the opening 11.

The heat exchanger 30 may have a substantially square shape, and a piping portion 60 may be formed at one corner. A refrigerant in the heat exchanger 30 may be discharged through the piping portion 60. In addition, the heat exchanger 30 may be coupled to the outer wall 10*b* through one corner.

The heat exchanger 30 may be supported by the holder 70. The holder 70 may support the inner side 30*a* and the lower side 30*c* of the heat exchanger 30. In particular, a portion of the holder 70 may be disposed between the heat exchanger 30 and the drain tray 41 to support the lower side 30*c* of the heat exchanger 30.

The drain plate 40 may include the drain tray 41 and a coupling hole 42 of a substantially circular shape formed at a central portion of the drain tray 41. The drain plate 40 has a substantially square shape and may be coupled to the lower side of the cabinet 10. The drain plate 40 may be coupled to the grille 43 through the coupling hole 42. Through-holes 45 formed to be adjacent to the four corners may be disposed on the outside of the coupling hole 42.

The lower panel 50 may be coupled to the lower side of the drain plate 40. The lower panel 50 may have a substantially square shape, and include the openings 52 disposed in communication with the through-holes 45 at each corner to allow air in the cabinet 10 to be discharged. A lower opening 55 may be disposed on a lower side of the coupling hole 42, so that air may flow into the cabinet 10 through the hole 44 communicating with the lower opening 55.

Figure 4:
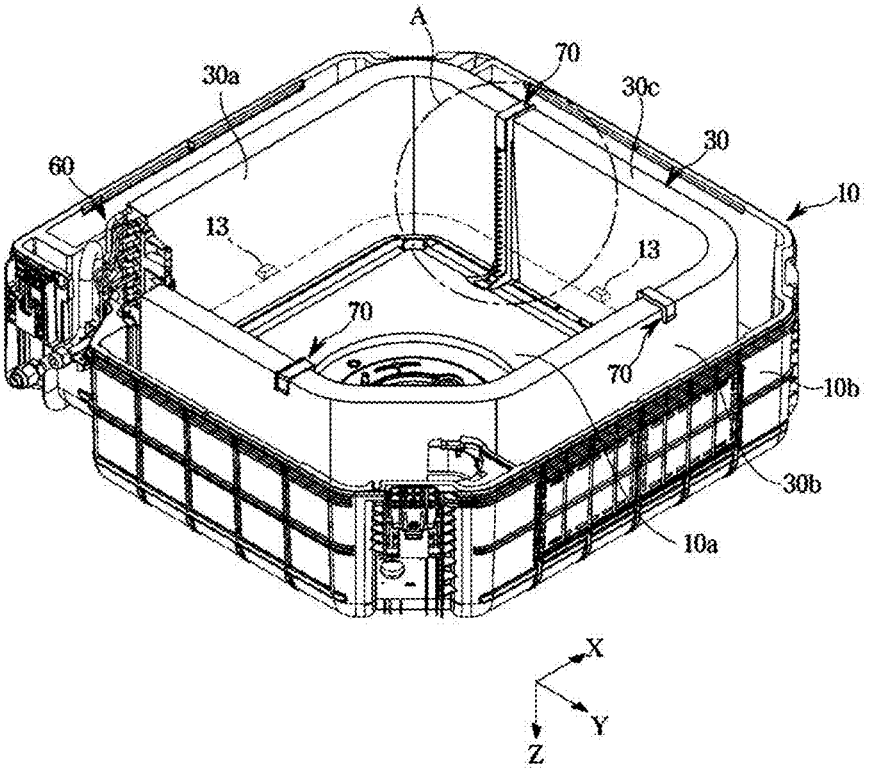
FIG. 4 is a perspective upside-down and inverted view of a cabinet and a heat exchanger coupled together as shown in FIG. 1 according to various embodiments.

FIG. 4 is an upside-down and inverted perspective view showing the cabinet 10, the heat exchanger 30, and the holder 70 coupled together according to various embodiments. Referring to FIG. 4, the heat exchanger 30 may be disposed within the square-shaped cabinet 10. The outer wall 10*b* of the cabinet 10 and the heat exchanger 30 may be arranged to be spaced apart, and an inner portion of the base 10*a* and the outer wall 10*b* of the cabinet 10 may be provided with an insulation.

The insulation (or thermal insulation) may be formed by foaming, and in particular, may be an expanded polystyrene (EPS) insulation. Such a configuration may allow the interior of the cabinet 10 to be formed to be insulated from the outside.

The cabinet 10 may include an outer protrusion 13 protruding downwardly (−Z direction) to correspond to a direction in which the outer wall 10*b* extends from the base 10*a* to be adjacent to the outer side 30*b* of the heat exchanger 30 (see FIG. 3). The outer protrusions 13 may be positioned to support a central portion of each side of the heat exchanger 30, and may be formed in four as shown in the drawings.

The holder 70 may be coupled to the base 10*a* from the upper side (Z direction) to support the lower side 30*c* of the heat exchanger 30 from the lower side (−Z direction). In other words, even if the drain tray 41 is disassembled from the heat exchanger 30, the holder 70 may support the lower side 30*c* of the heat exchanger 30, thereby preventing or restricting the heat exchanger 30 from being disassembled from the cabinet 10.

Referring to FIGS. 5, 6, 7, 8 and 9 (which may be referred to as FIGS. 5 to 9), the holder 70 may include a body 80, a support 100 arranged on one side of the body 80, and a cabinet coupling portion 90 provided on the other side of the body 80.

The body 80 may extend in a vertical direction (Z direction) and support the inner side 30*a* facing the centrifugal fan 20 side (see FIG. 2) of the heat exchanger 30. The holder 70 may include a plurality of inner ribs 81 arranged to reinforce the rigidity of the body 80 extending in a longitudinal direction, and may be spaced apart from each other in the vertical direction (Z direction).

The cabinet coupling portion 90 may be configured to be coupled to the cabinet 10, and in particular, may be formed to be coupled to the base 10*a* of the cabinet 10. The cabinet coupling portion 90 may be bent and extended from an upper end of the body 80.

Figure 11:
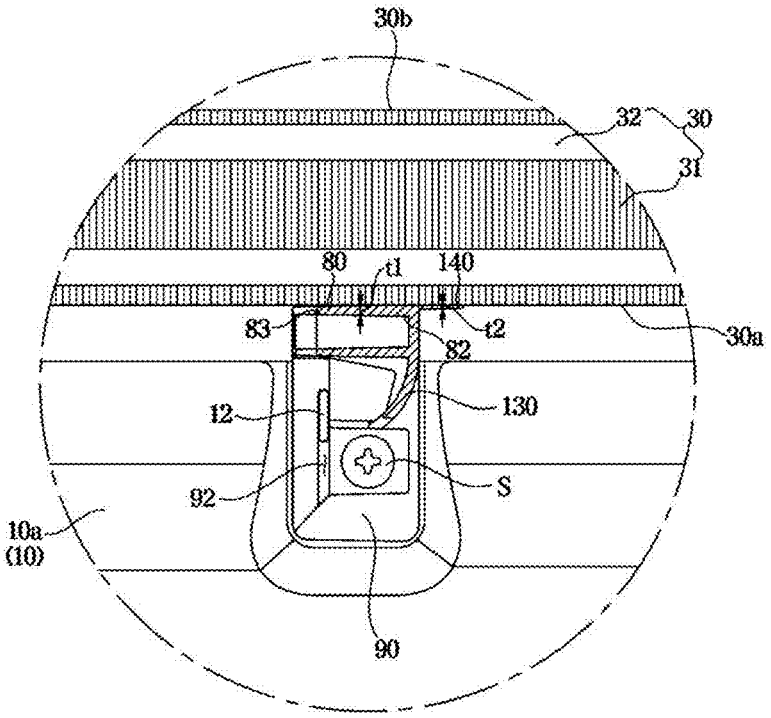
FIG. 11 is a cross-sectional view of the holder and the heat exchanger shown in FIG. 9, viewed from the bottom according to various embodiments.

The cabinet coupling portion 90 may include a guide hole 92 extending in the X direction, and a fastening hole 91 disposed adjacent to the guide hole 92 and formed to receive a separate fastener S (see FIG. 11).

The support 100 may be bent and extended from a lower end of the body 80 and may include an L-shape. The support 100 and the cabinet coupling portion 90 may extend from the body 80 in opposite directions. The support 100 may include a support plate 110 bent from the body 80 and a catch plate 120 bent from the support plate 110.

The support plate 110 may extend from the lower end of the body 80 between the drain tray 41 and the heat exchanger 30. The support plate 110 may be arranged to support the lower side 30*c* of the heat exchanger 30, and the catch plate 120 may be arranged to support the outer side 30*b* of the heat exchanger 30 (see FIG. 3). Such an arrangement may the catch plate 120 to be spaced apart from the body 80, and the heat exchanger 30 may be inserted into the space to be secured.

The holder 70 may include an air guide 130 protruding from the body 80 extending in the vertical direction (Z direction), and a cover 140.

The air guide 130 may protrude from one side of the body 80 toward the centrifugal fan 20, and the cover 140 may protrude from one side of the body 80 toward the heat exchanger 30. Here, one side of the body 80 may be a first side 82, which is an upstream side relative to a direction of airflow discharged from the centrifugal fan 20. A second side 83 may be a downstream side relative to the direction of the airflow discharged from the centrifugal fan 20.

In other words, the air guide 130 and the cover 140 may extend from the first side 82 of the body 80, which is the upstream side relative to the airflow discharged from the centrifugal fan 20. The air guide 130 may extend from the first side 82 of the body 80 toward the second side 83. In the drawings, the air guide 130 is shown as having a curved surface, but it is not limited thereto. In addition, the cover 140 may protrude from the first side 82 of the body 80 toward the inner side 30*a* of the heat exchanger 30.

Both the air guide 130 and the cover 140 may extend in the vertical direction (Z direction). Such a configuration is designed to oppose the airflow discharged from the centrifugal fan 20.

The air guide 130 may protrude forward (−X direction) from the first side 82 of the body 80, and a divider 133 may be formed at a distal end 132 of the air guide 130 to form a guide groove 131. The divider 133 may be extended to correspond to a direction extending from the first side 82 of the body of the air guide 130.

For example, the divider 133 may be provided in a plurality to be arranged in the vertical direction (Z direction), and a plurality of guide grooves 131 may be formed between adjacent dividers 133.

According to such a configuration, the airflow discharged from the centrifugal fan 20 may encounter the air guide 130, be dispersed by the divider 133, and then pass through each guide groove 131. In addition, the airflow flowing toward the air guide 130 side may bypass the holder 70 by the dividers 133. In other words, the discharge airflow bypassed by the air guide 130 may flow in parallel with heat exchange fins 31, thereby reducing the magnitude of turbulence. As a result, the noise that may be generated while passing through the heat exchanger 30 may be relatively reduced.

The air guide 130 may be arranged in the vertical direction (Z direction) between a lower end 134 and an upper end 135, and the side of the air guide 130 adjacent to the lower end 134 and the side of the air guide 130 adjacent to the upper end 135 may be provided with different curvatures. For example, the upper end 135 of the air guide 130 may be closer to the centrifugal fan 20 than the lower end 134, so that the curvature of the upper end 135 may be greater than the curvature of the lower end 134 to guide a stronger discharged airflow. However, the present disclosure is not limited thereto.

The cover 140 may be formed on the first side 82 where the air guide 130 extends from the body 80, and may be formed to cover a space between the body 80 and the heat exchanger 30.

The heat exchanger 30 may have a square shape, which may be convexly bent outwardly from its original shape because it includes a portion bent into a square shape. Such a structure may cause a gap between the holder 70 and the heat exchanger 30 to widen, and the cover 140 may prevent and/or reduce air from leaking through the gap. In other words, the cover 140 may guide the air directing between the holder 70 and the heat exchanger 30 toward the air guide 130.

The cover 140 may have an angle θ1 between 20 degrees and 75 degrees with respect to an extending direction of the support plate 110 (X direction). When the angle θ1 between the cover 140 and the extending direction of the support plate 110 is less than 20 degrees, the cover 140 may be bent excessively toward the support plate 110 despite contact with the heat exchanger 30. In addition, when the angle θ1 between the cover 140 and the extending direction of the support plate 110 is greater than 75 degrees, although the cover 140 is in contact with the heat exchanger 30, the gap between the heat exchanger 30 and the cover 140 may be further away.

The cover 140 may be formed to be inclined at the angle θ1 with respect to the heat exchange fins 31. As the holder 70 is coupled to the heat exchanger 30, the cover 140 may be deformed to cover the space between the heat exchanger 30 and the body 80.

In other words, since the cover 140 protrudes at an angle from the body 80, air may be prevented and/or reduced from escaping from the heat exchanger 30 and the cover 140.

The cover 140 may extend from the first side 82 of the body 80 at an angle θ2 of 15 to 70 degrees with respect to a lateral direction (Y direction) of the body 80. Here, the lateral direction (Y direction) of the body may be a direction parallel to the inner side 30*a* of the heat exchanger.

The cover 140 may extend from the first side 82 of the body 80 toward the heat exchanger 30 side to guide the airflow discharged from the centrifugal fan 20. The cover 140 may extend downward (−Z direction) from the cabinet coupling portion 90 toward the support 100. An upper end 142 of the cover 140 may be adjacent to the cabinet coupling portion 90, and a lower end 141 may be adjacent to the support 100. A protruding length W2 at the upper end 142 of the cover 140 may be greater than a protruding length W1 at the lower end 141.

In addition, the lower end 141 of the cover 140 may be cut away from the body 80.

Since the upper side (Z direction) of the holder 70 is not coupled to the heat exchanger 30 but is coupled to the cabinet 10, the holder 70 may be spaced away from the heat exchanger 30 at the upper side of the holder 70. In contrast, at the lower side (−Z direction) of the holder 70, the support 100 may be formed to surround a lower side of the heat exchanger 30 so as to secure the heat exchanger 30, so that a spacing distance between the holder 70 and the heat exchanger 30 may be relatively smaller than at the upper side. For this reason, the cover 140 may be formed such that the protruding length W2 of the cover 140 at the upper end 142 adjacent to the cabinet coupling portion 90 is wider than the protruding length W1 at the lower end 141 adjacent to the support 100.

Such a configuration may allow the space between the heat exchanger 30 and the holder 70 to be covered more efficiently, and the airflow discharged from the centrifugal fan 20 to be effectively guided toward the air guide 130.

The holder 70 may be relatively weaker at the first side 82 than at the second side 83 of the body 80. To assist in reinforcing such a structure, an outer rib 150 may be formed on the first side 82 of the holder 70. The outer rib 150 may extend downwardly (−Z direction) from the cabinet coupling portion 90 to correspond to the body 80 and may extend to correspond to a bending direction (X direction) of the support 100.

A distance between the lower end 134 of the air guide 130 and the lower end of the body 80 may be defined as d2, and a distance between the lower end 141 of the cover 140 and the lower end of the body 80 may be defined as d1. The lower end 141 of the cover 140 may extend further downwardly (−Z direction) than the lower end 134 of the air guide 130. In other words, the minimum distance d1 between the lower ends of the cover 140 and the body 80 may be set to be less than the minimum distance d2 between the lower ends of the air guide 130 and the body 80.

Such a configuration may guide the airflow from a side adjacent to the upper end 142 of the cover 140, which is relatively closer to the centrifugal fan 20, to the side of the air guide 130. Since the airflow on the side adjacent to the lower end 141 of the cover 140 may be relatively weaker than the side of the upper end 142, the air guide 130 may not extend to the lower end 141 of the cover 140. In other words, such a configuration may guide the airflow discharged from the centrifugal fan 20 while more efficiently covering the space between the holder 70 and the heat exchanger 30.

The support 100 may include the support plate 110 and the catch plate 120. A length of the catch plate 120 may be smaller than a length of the support plate 110.

The holder 70 may include a fastening protrusion 160 that protrudes from a portion of the lower side (−Z direction) of the body 80 and an inner side of the support 100 toward the heat exchanger 30. An upper end 121 of the catch plate 120 may be bent to face in the X direction.

An inner surface 122 of the upper end 121 of the catch plate 120 facing the body 80 may be the inclined surface 122 that slopes downwardly (−Z direction) to be closer to the body 80. The inclined surface 122 may be inclined downwardly toward the body 80 and the support plate 110 so as to guide the heat exchanger 30 toward the support plate 110 side. Such a configuration may make it relatively easy to guide the heat exchanger 30 into the space between the catch plate 120 and the body 80 when the heat exchanger 30 is coupled to the holder 70.

Figure 10:
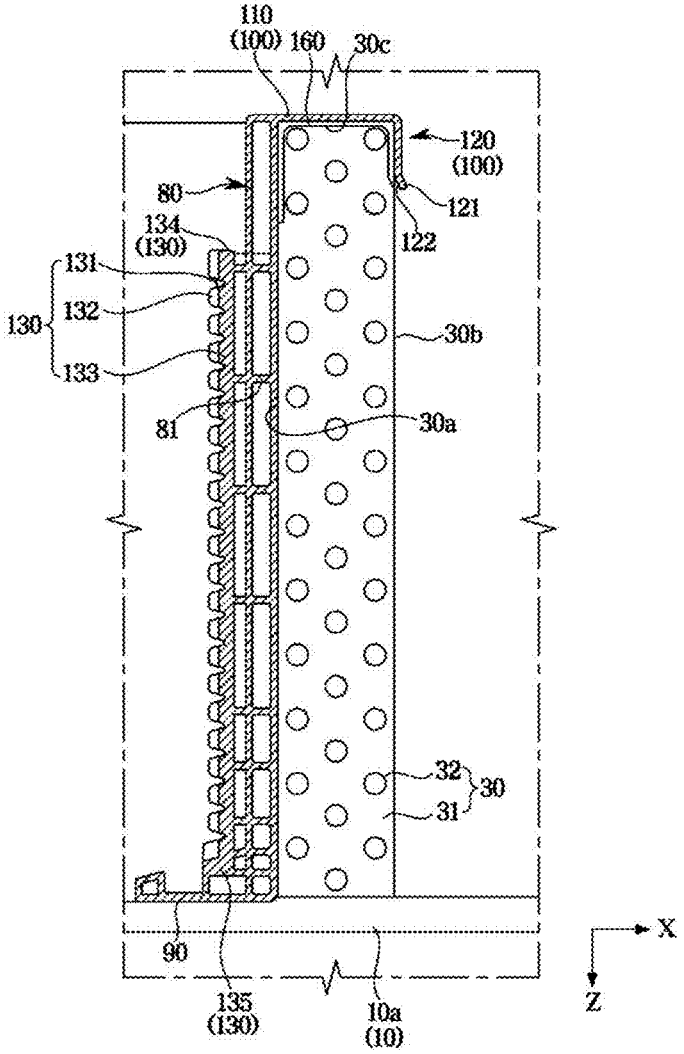
FIG. 10 is a cross-sectional view taken along the line I-I' of FIG. 9 according to various embodiments.

Referring to FIGS. 10 and 11, the heat exchanger 30 may include refrigerant pipes 32 arranged to surround the centrifugal fan 20 and the heat exchange fins 31 arranged along the refrigerant pipes 32. The heat exchange fins 31 may be spaced apart from each other to allow air to flow into a space between the heat exchange fins 31 to exchange heat with the refrigerant pipes 32.

The inner side 30*a* and the outer side 30*b* of the heat exchanger 30 may be defined by the heat exchange fins 31, and for example, the inner side 30*a* of the heat exchanger 30 may be the centrifugal fan 20 side and the outer side 30*b* may be the outer wall 10*b* of the cabinet 10 side. The heat exchange fins 31 may be closely spaced, but some may be deformed, so that a distance between adjacent heat exchange fins 31 may become increased or decreased.

The support 100 may include the support plate 110 extending from the lower end of the body 80 to the outer side 30*b* of the heat exchanger 30, and the catch plate 120 bent upwardly (Z direction) from the outer end of the support plate 110.

The fastening protrusion 160 of the support 100 may be inserted between the heat exchange fins 31 and coupled to the heat exchanger 30 while deforming the heat exchange fins 31 to increase the distance between adjacent heat exchange fins 31. For example, the fastening protrusion 160 protruding toward the heat exchanger 30 may be easily inserted between the adjacent heat exchange fins 31. The fastening protrusion 160 inserted between the adjacent heat exchange fins 31 may be pressed by the heat exchange fins 31 to allow the holder 70 to be relatively strongly coupled to the lower side 30*c* of the heat exchanger 30.

The cabinet 10 may include a guide protrusion 12 protruding toward the holder 70. The guide protrusion 12 may protrude downwardly (−Z direction) from the base 10*a*. The cabinet coupling portion 90 of the holder 70 may include the fastening hole 91 (see FIG. 8) formed to insert the fastener S disposed at the central portion thereof, and the guide hole 92 extending adjacent to the fastening hole 91 toward the heat exchanger 30. In other words, the guide hole 92 may extend in the X direction.

When the cabinet coupling portion 90 is coupled to the cabinet 10, a user may insert the guide protrusion 12 into the guide hole 92 and insert the fastener S into the fastening hole 91, thereby securing the cabinet coupling portion 90 to the cabinet 10. According to such a structure, by first inserting the guide protrusion 12 into the guide hole 92, the cabinet coupling portion 90 may be temporarily fixed to the cabinet 10 with relative ease. Furthermore, when the guide protrusion 12 is inserted into the guide hole 92, the cabinet coupling portion 90 may be difficult to rotate. As a result, the rotation of the cabinet coupling portion 90, which often occurs when the fastener S is inserted into the fastening hole 91 during rotation, may be avoided.

The cover 140 may be arranged to be smaller than a thickness t1 of the body 80. For example, a thickness t2 of the cover 140 may be ¼ to ⅔ of the thickness t1 of the body 80. If the cover 140 has a thickness within such a range, the cover 140 may be deformed upon contact with the heat exchanger 30. If the cover 140 has a thickness smaller than such a range, the cover 140 may be deformed but damaged due to a thin thickness. In addition, if the cover 140 is provided with an excessive thickness, the cover 140 may not be deformed when in contact with the heat exchanger 30 and may cause damage to the heat exchange fins 31 or the refrigerant pipes 32.

On the other hand, the holder 70 may include a synthetic resin. The holder 70 supporting the heat exchanger 30 may be relatively less expensive than if the holder includes metal. Furthermore, compared to the case where a member supporting the heat exchanger 30 and a member guiding the air are provided separately, the number of parts may be reduced due to the holder 70 being a single member, thereby reducing manufacturing costs and installation time. In addition, due to the feature of the cover 140 being made of a synthetic resin, the cover 140 may be deformed in contact with the heat exchanger 30, thereby covering the space between the heat exchanger 30 and the holder 70.

Figure 12:
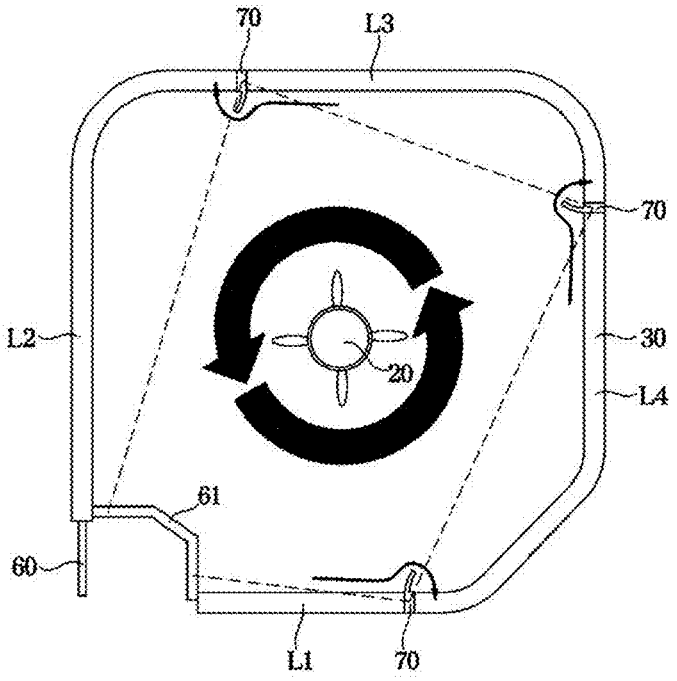
FIG. 12 is a diagram illustrating a position in which the holder is installed when a centrifugal fan rotates counterclockwise according to various embodiments.
Figure 13:
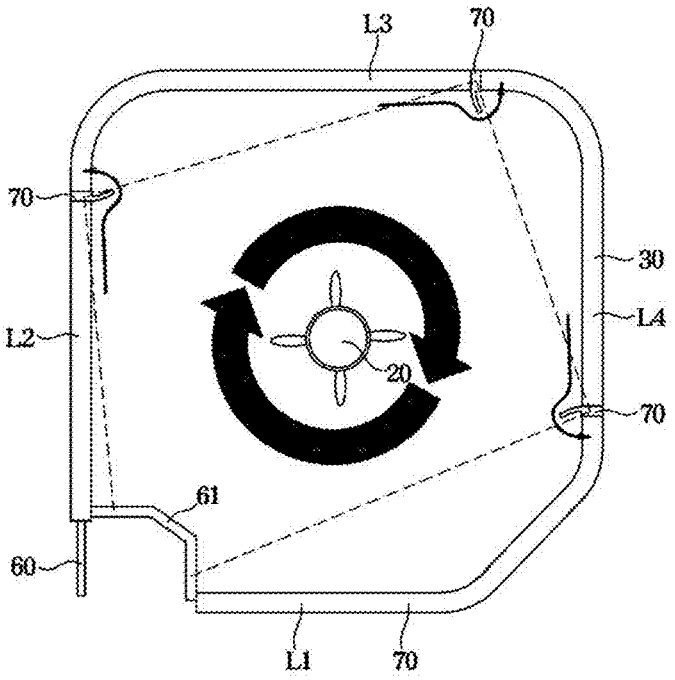
FIG. 13 is a diagram illustrating a position in which the holder is installed when the centrifugal fan rotates clockwise according to various embodiments.

With reference to FIGS. 12 and 13, a position where a plurality of holders 70 are provided and installed will be described in detail. The heat exchanger 30 may have a substantially square shape. In particular, the piping portion 60 may be disposed adjacent to one corner of the heat exchanger 30. In addition, an assembly portion 61 may be disposed at one corner of the heat exchanger 30 to enable one corner of the heat exchanger 30 to be secured to the cabinet 10.

The heat exchanger 30 may include a first side L1 and a second side L2 which are adjacent to the piping portion 60. The heat exchanger 30 may include a third side L3 and a fourth side L4 arranged in parallel with the first side L1 and the second side L2, respectively. Here, the first side L1 and the fourth side L4 may be formed so that one corner not adjacent to the pipe portion 60 is bent as shown in the drawings.

As shown in FIG. 12, when the centrifugal fan 20 discharges the airflow in a counterclockwise direction, the holder 70 may be arranged on the first side L1, the fourth side L4, and the third side L3.

For example, the holder 70 disposed on the first side L1 may be disposed closer to the corner adjacent to the fourth side L4 than to the corner adjacent to the second side L2 of both corners. The holder 70 disposed on the fourth side L4 may be disposed relatively closer to the third side L3 of both corners, and the holder 70 disposed on the third side L3 may be disposed relatively closer to the corner adjacent to the second side L2.

Such a structure may be designed to prevent and/or reduce the airflow discharged from the centrifugal fan 20 from flowing in the heat exchange 30 more from the downstream side than the upstream side, causing the airflow to intersect with the heat exchange fins 31 to generate significant noise.

In such a case, the holder 70 may be installed so that the center of gravity of the heat exchanger 30 is positioned within a region connecting each the holder 70 and assembly portion 61, thereby providing more stable support for the heat exchanger 30. In addition, the airflow discharged from the centrifugal fan 20 may be guided by the holder 70 to flow in parallel with the heat exchange fins 31 arranged along the refrigerant pipes 32 (see FIG. 11) surrounding the centrifugal fan 20. According to such a structure, the appropriate arrangement of the holder 70 may allow the heat exchanger 30 to be stably supported, and at the same time, reduce the noise of the heat exchange 30 by redirecting the air that may flow in a direction intersecting the heat exchange fins 31.

In addition, unlike shown in the drawings, the holder 70 may be additionally disposed on the second side L2, and thus the holder 79 may be closer to the corner adjacent to the piping portion 60 and the assembly portion 61 of both corners.

As shown in FIG. 13, when the centrifugal fan 20 discharges air in a clockwise direction, the plurality of holders 70 may be installed on the second side L2, the third side L3, and the fourth side L4. For example, the holders 70 disposed on the second side L2, the third side L3, and the fourth side L4 may be disposed in a downstream direction relative to a direction in which the air is discharged. In other words, the holder 70 on the second side L2 may be disposed closer to the corner that is not adjacent to the pipe portion 60, and the holder 70 on the third side L3 may be disposed closer to the corner that is adjacent to the fourth side L4. In addition, the holder 70 on the fourth side L4 may be disposed closer to the first side L1.

Similarly, the plurality of holders 70 may be installed on the heat exchanger 30 such that the center of gravity of the heat exchanger 30 is positioned within the region where the assembly portion 61 and the holder 70 are connected.

Figure 14:
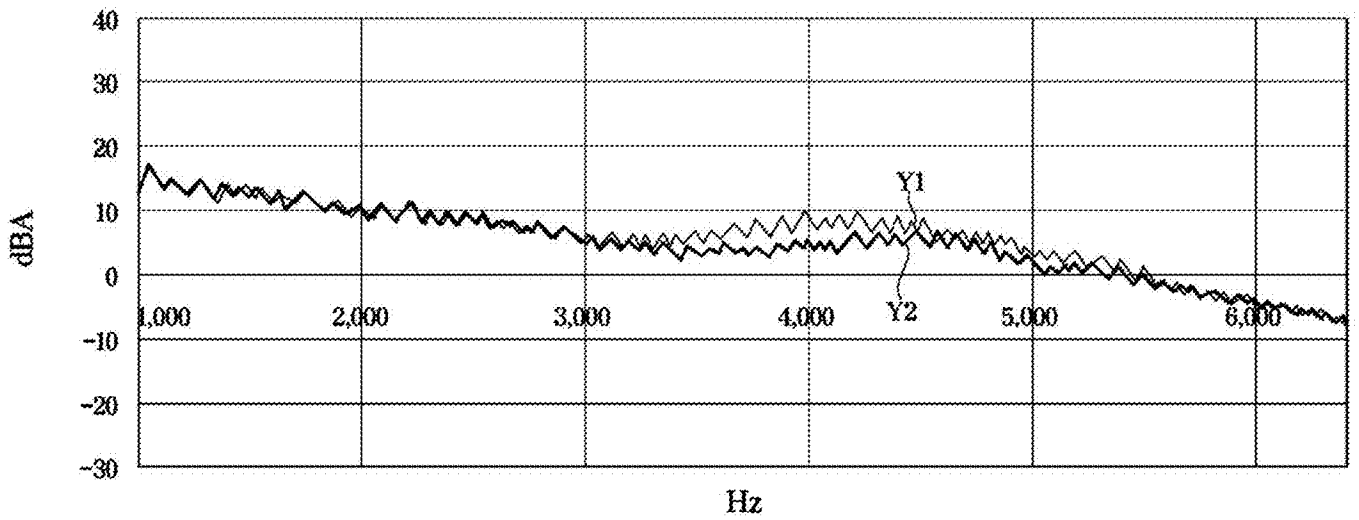
FIG. 14 is a graph illustrating the noise of the holder with and without a cover according to various embodiments.

FIG. 14 is a graph comparing, based on the ceiling-type air conditioner with a power consumption of 10 KW, the noise that may be generated by the heat exchange fins 31 (see FIG. 11) of the ceiling-type air conditioner Y1 including the air guide 130 and the ceiling-type air conditioner Y2 including the air guide 130 and the cover 140. Referring to FIG. 14, it can be seen that compared to the ceiling-type air conditioner Y1 including the air guide 130, the ceiling-type air conditioner Y2 including the air guide 130 and the cover 140 may provide the noise reduced by up to 7 dBA around the 4000 Hz frequency region.

In other words, the ceiling-type air conditioner 1 including the air guide 130 and the cover 140 may reduce the noise that may be generated by the contact of the heat exchange fins 31 and the airflow discharged from the centrifugal fan 20 more than the ceiling-type air conditioner without the cover 140.

Figure 5:
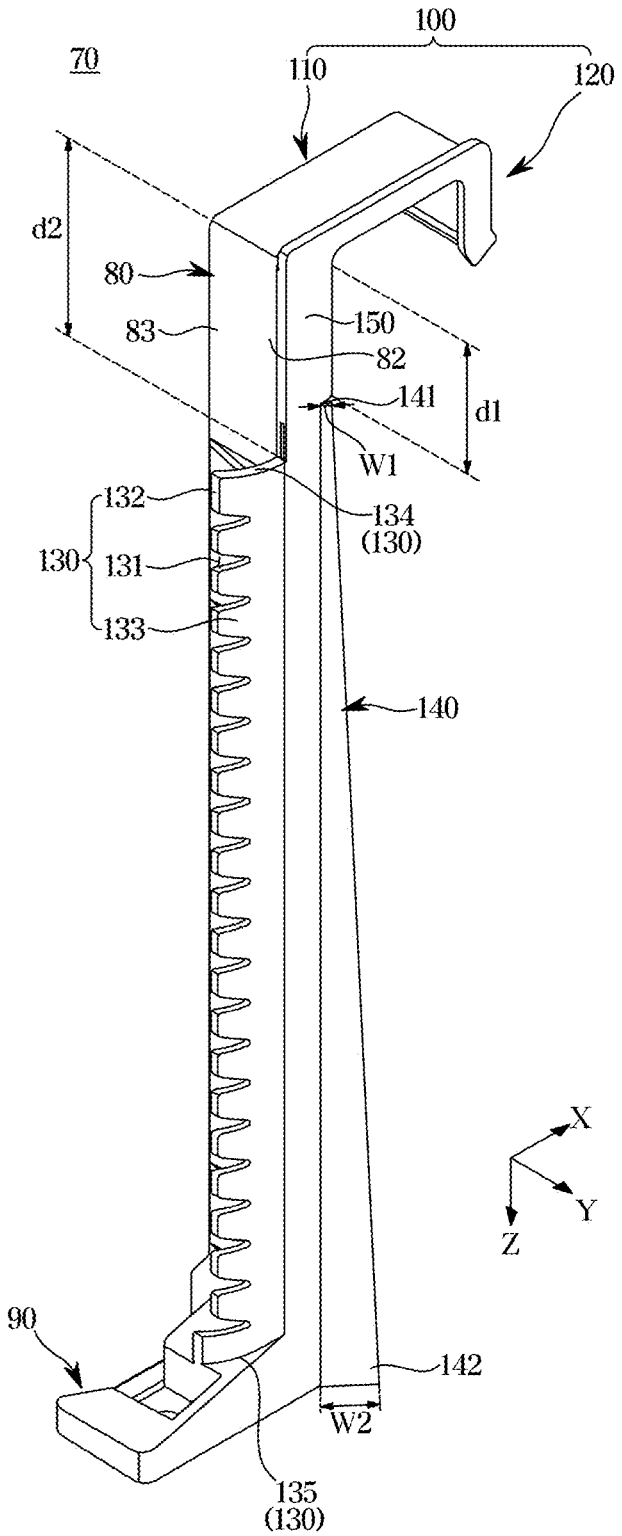
FIG. 5 is a perspective view of a holder according to various embodiments.
Figure 6:
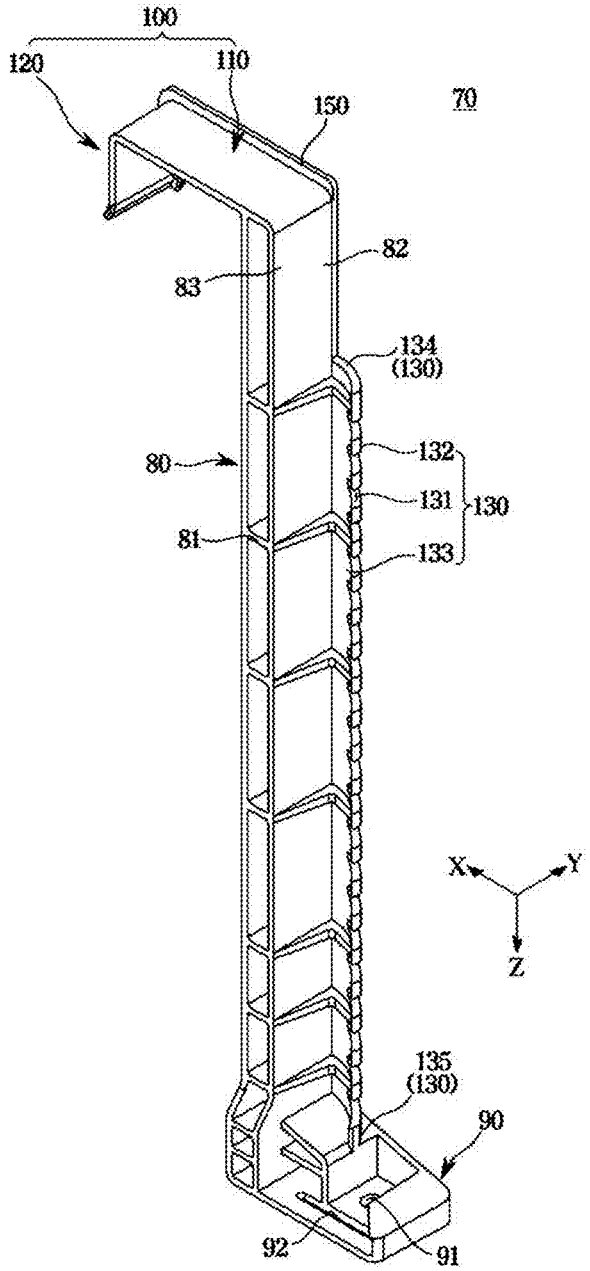
FIG. 6 is a perspective view of the holder shown in FIG. 5 from a different angle according to various embodiments.
Figure 7:
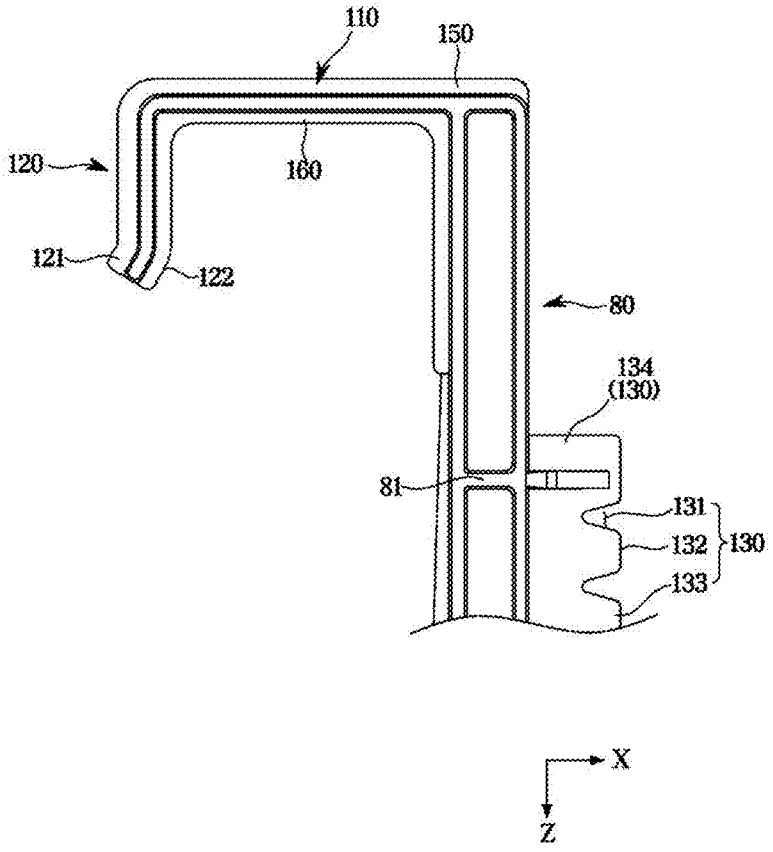
FIG. 7 is an enlarged cross-sectional view of a support side of the holder shown in FIG. 5 according to various embodiments.
Figure 8:
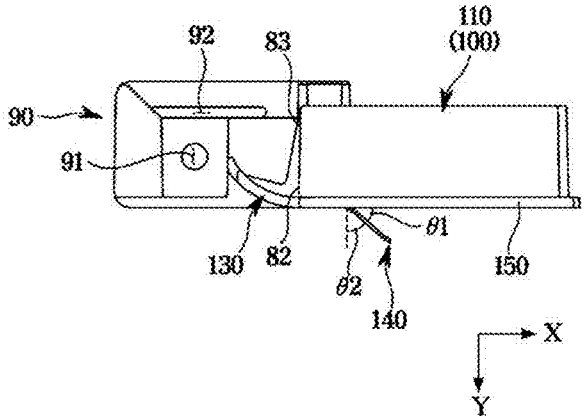
FIG. 8 is a diagram illustrating a bottom view of the holder shown in FIG. 5 according to various embodiments.
Figure 9:
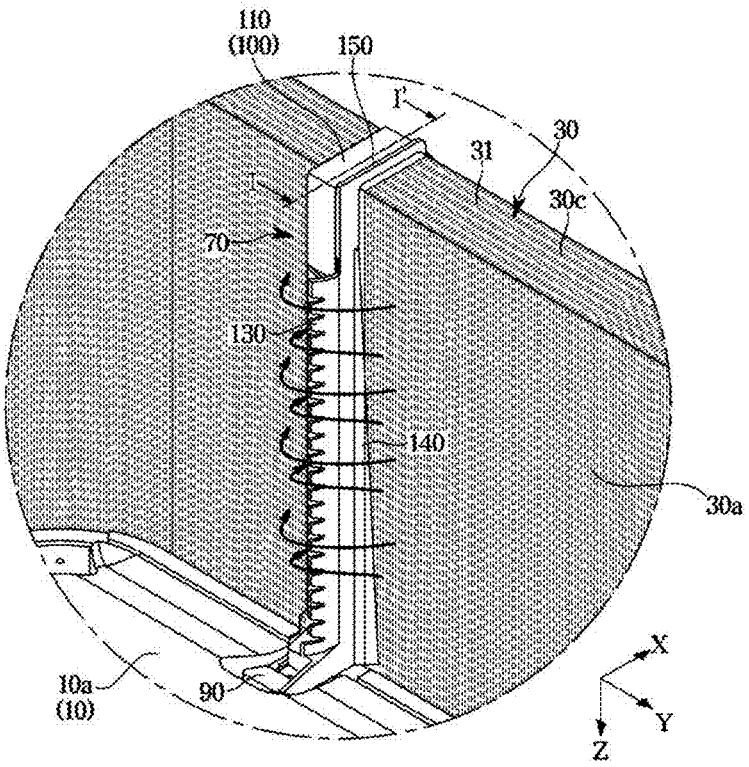
FIG. 9 is an enlarged perspective view of area A shown in FIG. 4 according to various embodiments.
Figure 15:
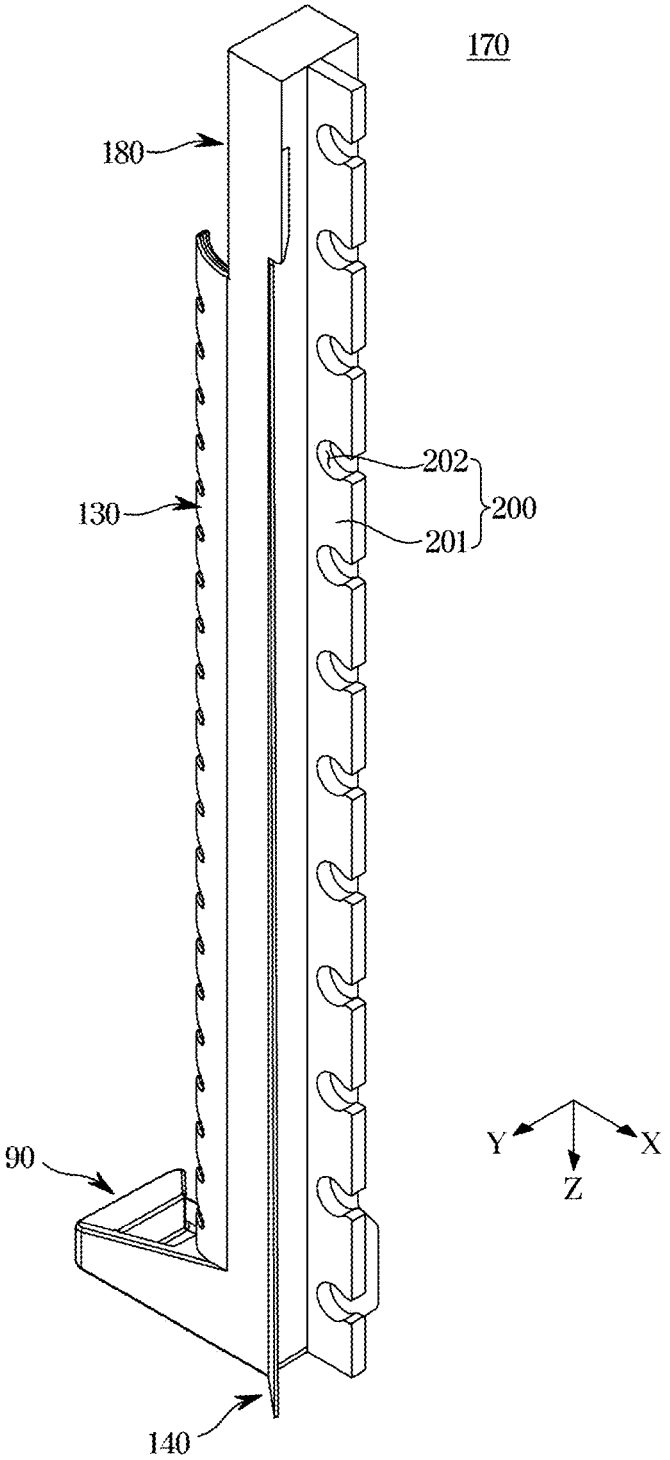
FIG. 15 is a perspective view of a holder according to various embodiments.

With reference to FIGS. 5 and 15, a holder 170 according to an embodiment will be described. In contrast to the holder 70 according to an embodiment, the holder 170 may include a locking portion 200 that is not a structure, such as the support 100. The locking portion 200 may include a locking protrusion 201 protruding from the outer surface of the body 180 toward the heat exchanger 30 (see FIG. 11) in a direction in which the support 100 of the holder 70 according to an embodiment extends (X direction). A plurality of locking protrusions 201 may extend in the vertical direction (Z direction) to form locking grooves 202 between the locking protrusions 201.

The locking grooves 202 may correspond to the outer portion of the plurality of refrigerant pipes 31 of the heat exchanger 30 and may be formed to hold the plurality of refrigerant pipes 31. As a result, the holder 170 may be secured to the plurality of refrigerant pipes 31.

The plurality of refrigerant pipes 31 may be inserted into the plurality of locking grooves 202, and each of the plurality of locking protrusions 201 may press against the plurality of refrigerant pipes 31. According to such a structure, the holder 170 may be provided that is able to be coupled to the cabinet 10 (see FIG. 2) and to the heat exchanger 30 without a separate support 100 structure.

Figure 16:
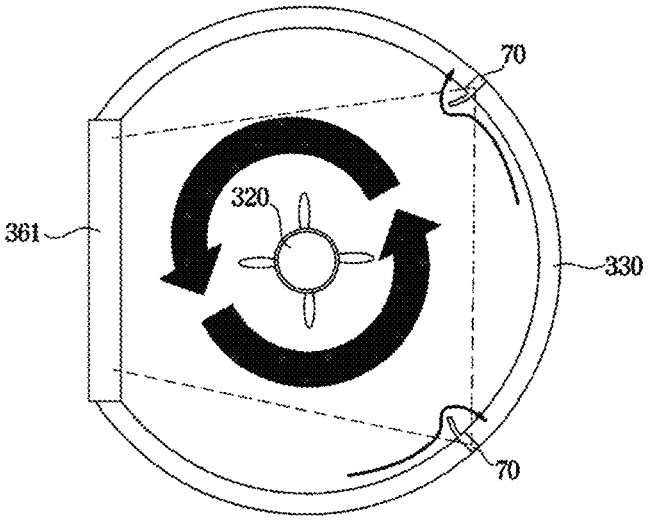
FIG. 16 is a diagram illustrating a holder installed in a heat exchanger including a circular shape, according to various embodiments.

With reference to FIG. 16, the arrangement of a heat exchanger 330 and the holder 70 according to an embodiment will be described. In contrast to the heat exchanger 30 according to an embodiment, an assembly portion 361 and a wiring portion may be disposed on one side of the heat exchanger 330 having a circular shape. When a centrifugal fan 320 discharges air in a counterclockwise direction as shown in the drawings, the holder 70 may be positioned such that the center of gravity of the heat exchanger 330 is within a region connecting the holder 70 and the assembly portion 361. As a result, the holder 70 may stably support the heat exchanger 330 and at the same time relatively reduce the noise that may be generated by the circular heat exchanger 330.

However, as shown in the drawings, the number of the holders 70 is not limited to two, and any position that is effective in reducing the noise of the heat exchanger 330 and the arrangement in which the center of gravity of the heat exchanger 330 is disposed on the inner side of the holder 70 and the assembly portion 361 are sufficient. In addition, when the centrifugal fan 320 rotates in the opposite direction to discharge air clockwise, each holder 70 may be installed facing the opposite direction as shown in the drawings.

While the present disclosure has been illustrated and described with reference to various example embodiments, it be understood that the various embodiments are intended to be illustrative, not limiting. It will be further understood by those skilled in the art that various changes in form and detail may be made without departing from the true spirit and full scope of the disclosure, including the appended claims and their equivalents. It will also be understood that any of the embodiment(s) described herein may be used in conjunction with any other embodiment(s) described herein.

What is claimed is:

1. A ceiling air conditioner comprising:

a cabinet mountable on a ceiling;

a centrifugal fan disposed at least partially within the cabinet;

a heat exchanger configured to exchange heat with air discharged from the centrifugal fan; and a holder adjacent to the heat exchanger and disposed between at least the heat exchanger and the centrifugal fan and configured to support the heat exchanger;

wherein the holder comprises:

a body extending vertically along an inside of the heat exchanger, an air guide protruding from the body toward a centrifugal fan side and that guides airflow discharged from the centrifugal fan, and a cover protruding from the body toward the heat exchanger and configured to cover between the body and the heat exchanger, and wherein:

the body includes a first side disposed on an upstream side of a direction of the airflow to be discharged from the centrifugal fan and a second side disposed on a downstream side of the direction of the airflow, the cover protrudes from the first side of the body radially outward relative to the heat exchanger and guides the airflow toward the air guide, and the air guide extends from the first side of the body toward the second side of the body.

2. The ceiling air conditioner of claim 1, wherein the holder includes a support extending from the body and configured to support a lower side of the heat exchanger, and an angle formed by the cover with an extending direction of the support is in a range of 20 degrees to 75 degrees.

3. The ceiling air conditioner of claim 1, wherein the cover has a thickness in a range of ¼ times to ⅔ times the thickness of the body.

4. The ceiling air conditioner of claim 1, wherein the heat exchanger includes a refrigerant pipe arranged to at least partially surround the centrifugal fan, and heat exchange fins arranged along the refrigerant pipe, and the inside of the heat exchanger is defined by the heat exchanger fins, and the cover is arranged to contact the inside of the heat exchanger.

5. The ceiling air conditioner of claim 1, wherein the holder further includes a support extending from the body and configured to support a lower side of the heat exchanger, and a cabinet coupling portion coupled to the cabinet on the opposite side of the support, and the cover extends from the cabinet coupling portion toward the support.

6. The ceiling air conditioner of claim 5, wherein a protruding length of the cover on a side adjacent to the cabinet coupling portion is greater than a protruding length of the cover on a side adjacent to the support.

7. The ceiling air conditioner of claim 5, wherein a distance between the support and an end of the cover adjacent to the support is less than a distance between the support and an end of the air guide adjacent to the support.

8. The ceiling air conditioner of claim 1, wherein the holder further includes a support extending from the body and configured to support a lower side of the heat exchanger, the heat exchanger includes a refrigerant pipe arranged to at least partially surround the centrifugal fan, and heat exchange fins arranged along the refrigerant pipe, wherein the support comprises:

a support plate bent and extended from the body and configured to cover a portion of the lower side of the heat exchanger, a catch plate bent from the support plate in parallel with the body and configured to support an outside of the heat exchanger, and a fastening protrusion protruding from the support plate and the catch plate toward the heat exchanger and configured to be inserted between adjacent heat exchange fins of the heat exchange fins.

9. The ceiling air conditioner of claim 8, wherein the catch plate includes an inclined surface inclined downwardly toward the body and the support plate and configured to guide the heat exchanger toward the support plate.

10. The ceiling air conditioner of claim 1, wherein the air guide extends from the first side of the body along the direction of the airflow, and includes guide grooves arranged in a vertical direction at a distal end protruding from the body and configured to allow air discharged from the centrifugal fan to pass therethrough.

11. The ceiling air conditioner of claim 1, wherein the cabinet includes a guide protrusion protruding toward the holder and configured to be coupled to the holder, and the holder includes a guide hole into which the guide protrusion is configured to be inserted, a fastening hole disposed adjacent to the guide hole configured to allow a fastener to be inserted, and a cabinet coupling portion bent from the body.

12. The ceiling air conditioner of claim 1, wherein the holder is provided in a plurality, the heat exchanger includes a first side and a second side adjacent to a piping portion, and a third side and a fourth side arranged in parallel with the first side and the second side, the holder is installed on the third side and the fourth side, wherein the holder is disposed closer to a corner disposed on a downstream side of the direction of the airflow discharged from the centrifugal fan, of corners provided on both sides of each of the third side and the fourth side.

13. The ceiling air conditioner of claim 1, wherein the cabinet includes a base and an outer wall extending downwardly from an outside of the base, and an outer protrusion protruding downwardly from the base and configured to secure an outside of the heat exchanger.

14. The ceiling air conditioner of claim 1, wherein the holder comprises a synthetic resin.

* * * * *